US005921622A

United States Patent [19]

Newton

[11] Patent Number: 5,921,622

[45] Date of Patent: Jul. 13, 1999

[54] TABLE WITH SEATING

[75] Inventor: Maurice George Newton, Hainford, United Kingdom

[73] Assignee: Broadland Garden Furniture Limited, United Kingdom

[21] Appl. No.: 08/671,551

[22] Filed: Jun. 27, 1996

[51] Int. Cl.[6] ..... A47B 83/02

[52] U.S. Cl. ..... 297/157.1; 297/158.3; D6/337

[58] Field of Search ..... 297/157.1, 158.3; D6/337

[56] References Cited

U.S. PATENT DOCUMENTS

| | | | |
|---|---|---|---|
| D. 165,710 | 1/1952 | Currie et al. | 297/158.3 X |
| D. 173,910 | 1/1955 | Nevendorf | 297/158.3 X |
| D. 196,121 | 8/1963 | Soszynski | D6/337 |
| D. 279,433 | 7/1985 | Fuchs | D6/337 |
| D. 315,254 | 3/1991 | Walters | D6/337 |
| D. 360,536 | 7/1995 | Pelletier | D6/337 |
| 2,367,011 | 1/1945 | Demmien | 297/157.1 |
| 2,713,889 | 7/1955 | White | 297/158.3 |
| 3,120,405 | 2/1964 | Soszynski | 297/158.3 |
| 4,216,993 | 8/1980 | Shumaker | 297/158.3 |
| 4,917,436 | 4/1990 | Thom | 297/158.3 |
| 5,720,512 | 2/1998 | Hostetler | 297/158.3 X |

*Primary Examiner*—Peter M. Cuomo
*Assistant Examiner*—Rodney B. White
*Attorney, Agent, or Firm*—Galgano & Burke

[57] ABSTRACT

A multi-leg table characterized in that at least one leg of the table supports a seat squab in a manner, known generally per se wholly or largely independently of any further such support and in that the leg is or is sufficiently inherently resilient, that as a matter of deliberate design the weight of one or more persons sitting on the seat will cause the leg to move into contact with the ground if it is not already ground engaging, ie, if there is initially a gap between the foot of the leg and the ground on which the rest of the table is standing.

4 Claims, 24 Drawing Sheets

TABLE WITH SEATING

FIELD OF THE INVENTION

The present invention relates to tables with seating and is particularly—but not exclusively—applicable to tables for outdoor use.

BACKGROUND OF THE INVENTION

Conventional tables, whether for indoor or outdoor use, can suffer from many inherent drawbacks.

For example, the position of one or several legs of the table can prevent or restrict the number and positioning of chairs around the table. The main complaint being that persons sitting at the table run the risk of either not being able to sit close enough to the table, or if they do, their legs run the risk of "banging" against the leg(s) of the table which, at best, is a nuisance and at worst is extremely annoying.

Attempts to overcome these problems in the area of "outdoor" tables have usually involved the adoption of a design of table which has two sets of usually parallel planked "bench" type seats fitted to the legs of the table in a substantially parallel relationship to the longest sides of the table. These types of "bench" tables are seen throughout "pub" gardens in the United Kingdom and Europe. Similarly, this type of design of table is extremely popular in the kitchen (as a breakfast table) and in indoor cafeterias as they are economical in terms of space and seating capacity.

Nevertheless, these tables also suffer from the drawback of although, for example, providing adequate seating for three people on each side, can only truly accommodate two people on each side in open "comfort" by providing them with sufficient "elbow room" to eat their meal.

This simply replaces one problem with another. Furthermore, this parallel seating arrangement makes it difficult for social conversation as people often have to talk "across" other people which is not socially accepted. In addition, the use of such tables outside in, for example, "beer gardens" on ground that is usually uneven, often means that the table itself, either has to be supported under one leg with beer mats to "even out" the ground, or the table has to be placed in an unfavourable location where the ground is "more even".

Finally, the construction of such tables is usually carried out in such a way that they are not readily dismountable. As storage space is usually at as premium, such non-readily dismountable tables are usually left in the open all year around at the mercy of the elements. This tends to reduce their life considerably.

It is an object of the present invention to alleviate the problems specified above.

SUMMARY OF THE INVENTION

In its broadest aspect the invention incorporates a multi-leg table characterized in that at least one leg of the table supports a seat squab in a manner, known generally per se wholly or largely independently of any further such support and in that the leg is sufficiently inherently resilient, that as a matter of deliberate design the weight of one or more persons sitting on the seat will cause the leg to more into contact with the ground if it is not already ground engaging, ie, if there is initially a gap between the foot of the leg and the ground on which the rest of the table is standing.

DESCRIPTION OF THE PREFERRED EMBODIMENT

Throughout this specification, the use of the word "integral" is intended to cover not only something which is formed from the outset as one single-entity component but also anything which, whilst being assembled from a plurality of initially disparately-produced integers, ends up as one overall and normally non-dismountable structure.

Figure 1:
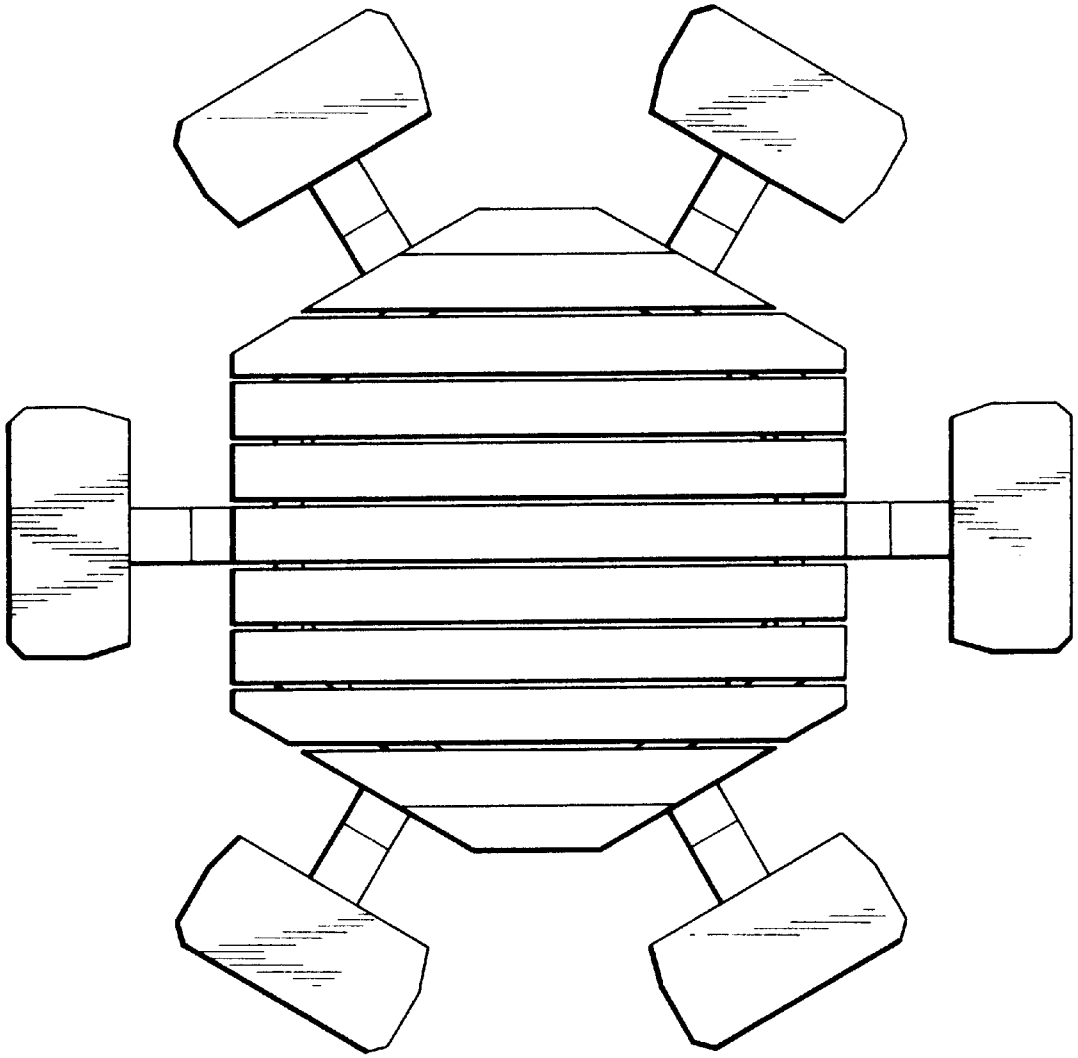
FIGS. 1–4 show respectively, top, side, perspective and underside views of one embodiment of the present invention.
Figure 2:
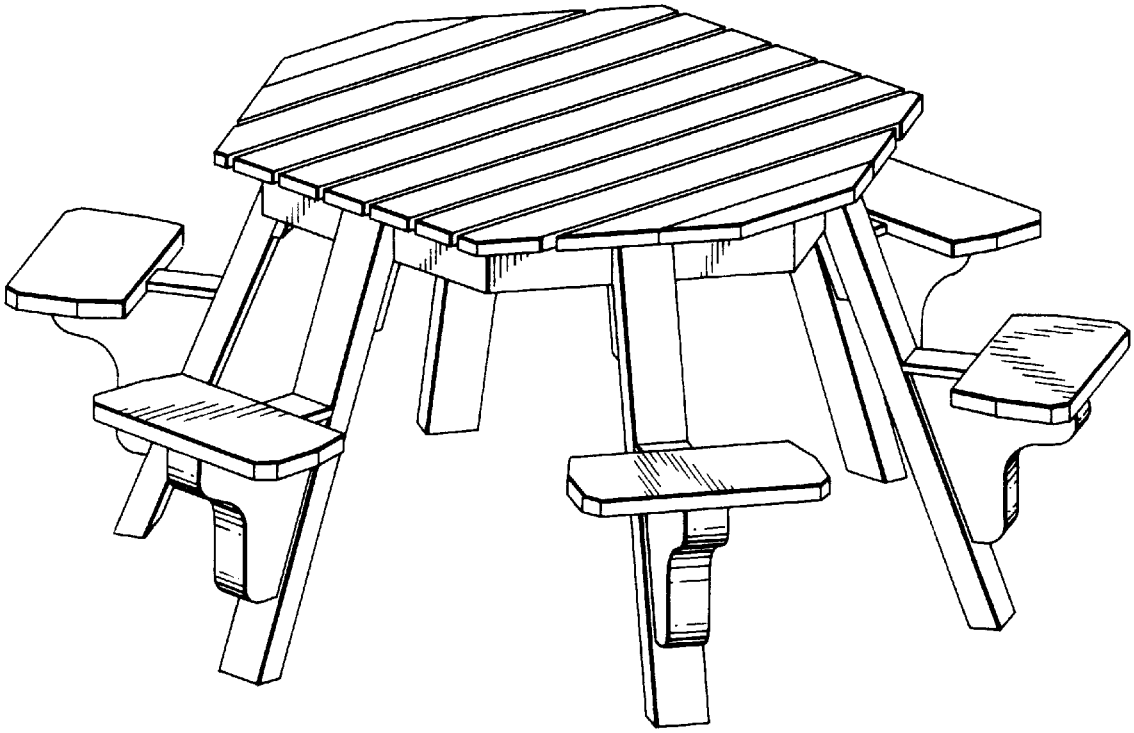
Figure 3:
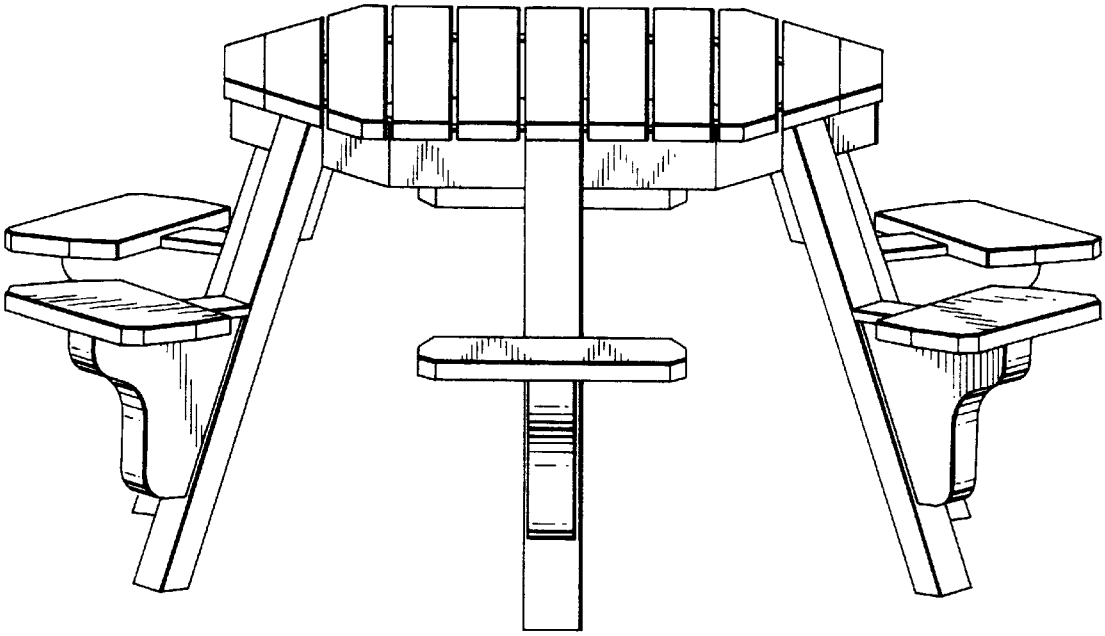
Figure 4:
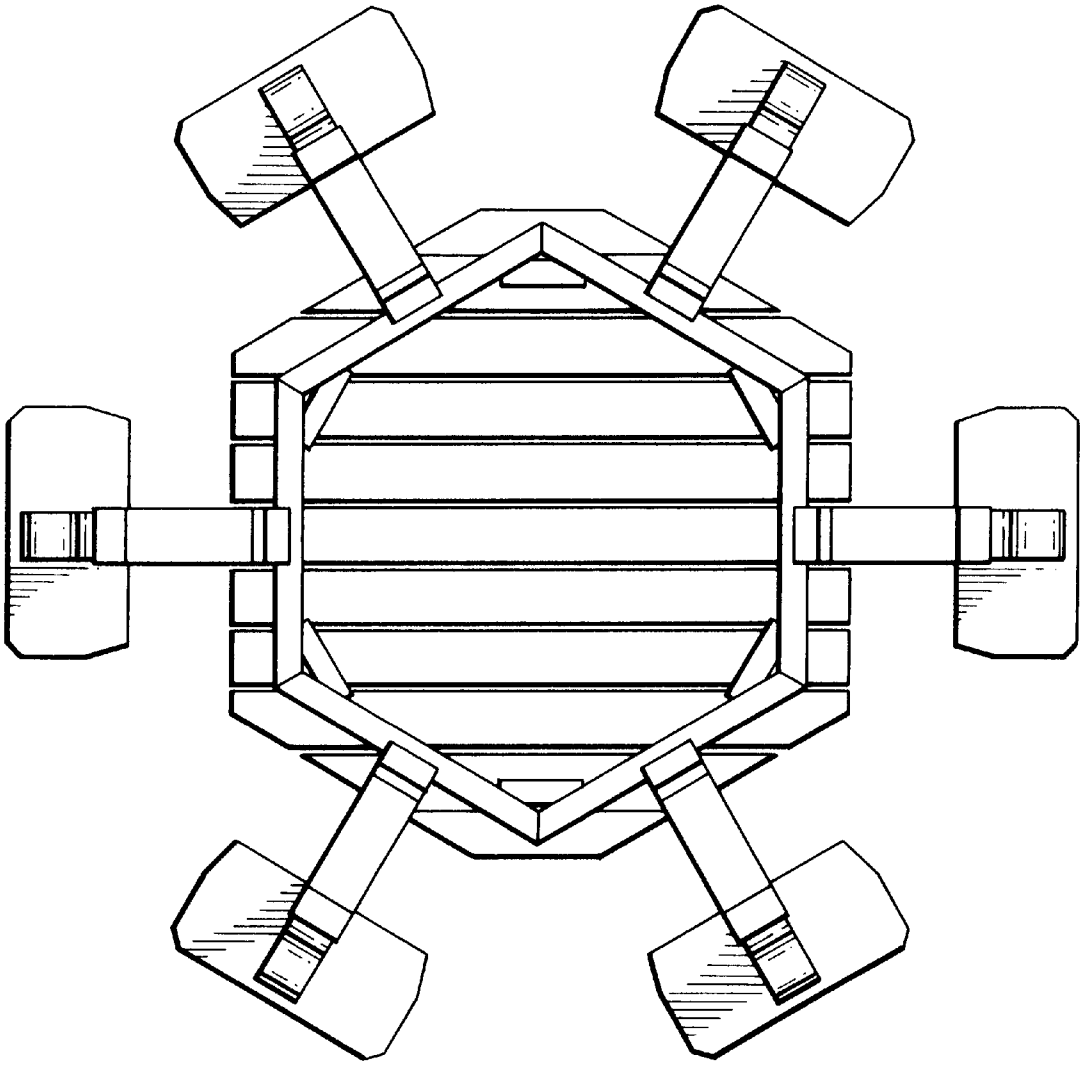
Figure 5:
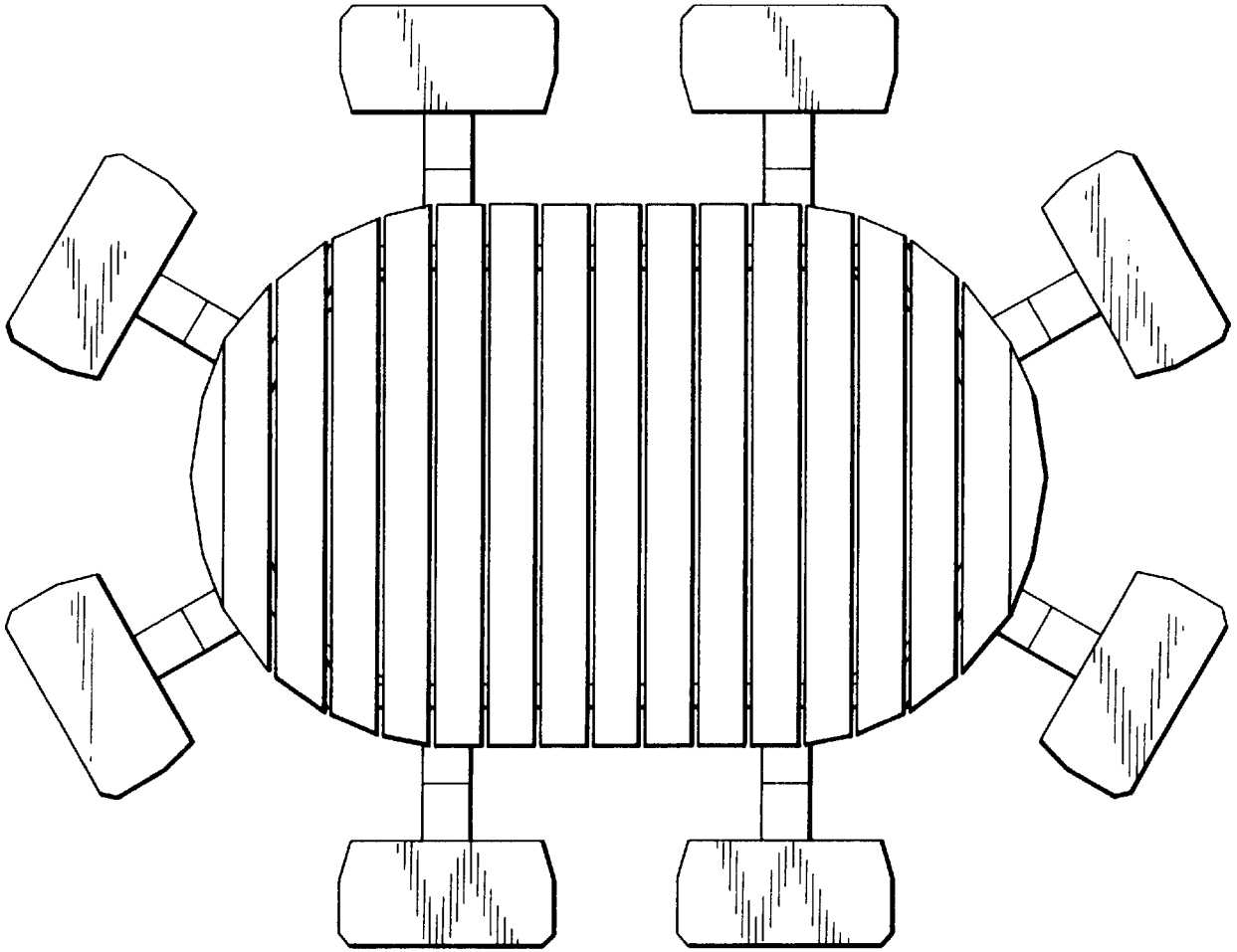
FIGS. 5–8 show respectively, top, side, perspective and underside views of a second embodiment of the present invention.
Figure 6:
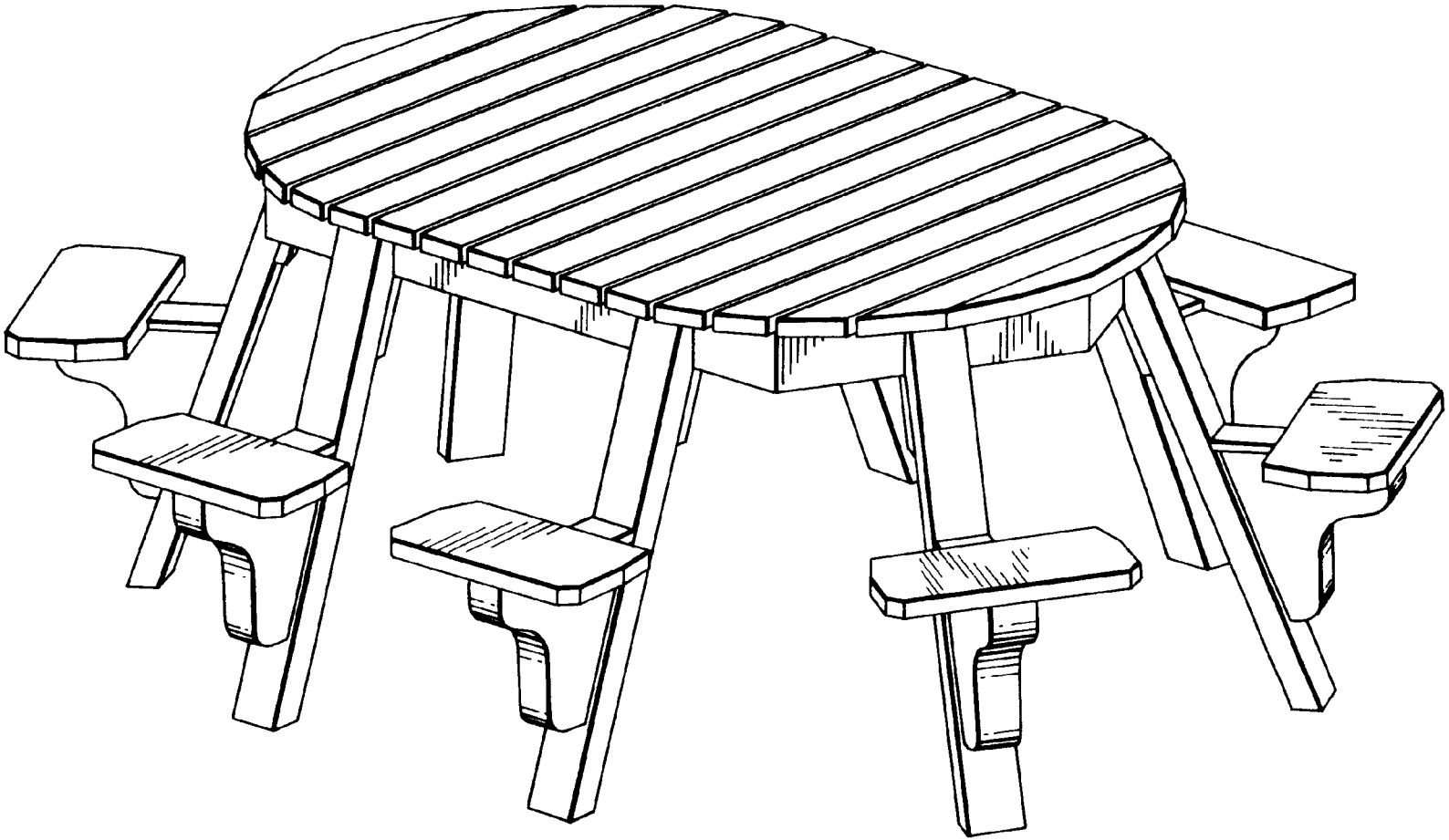
Figure 7:
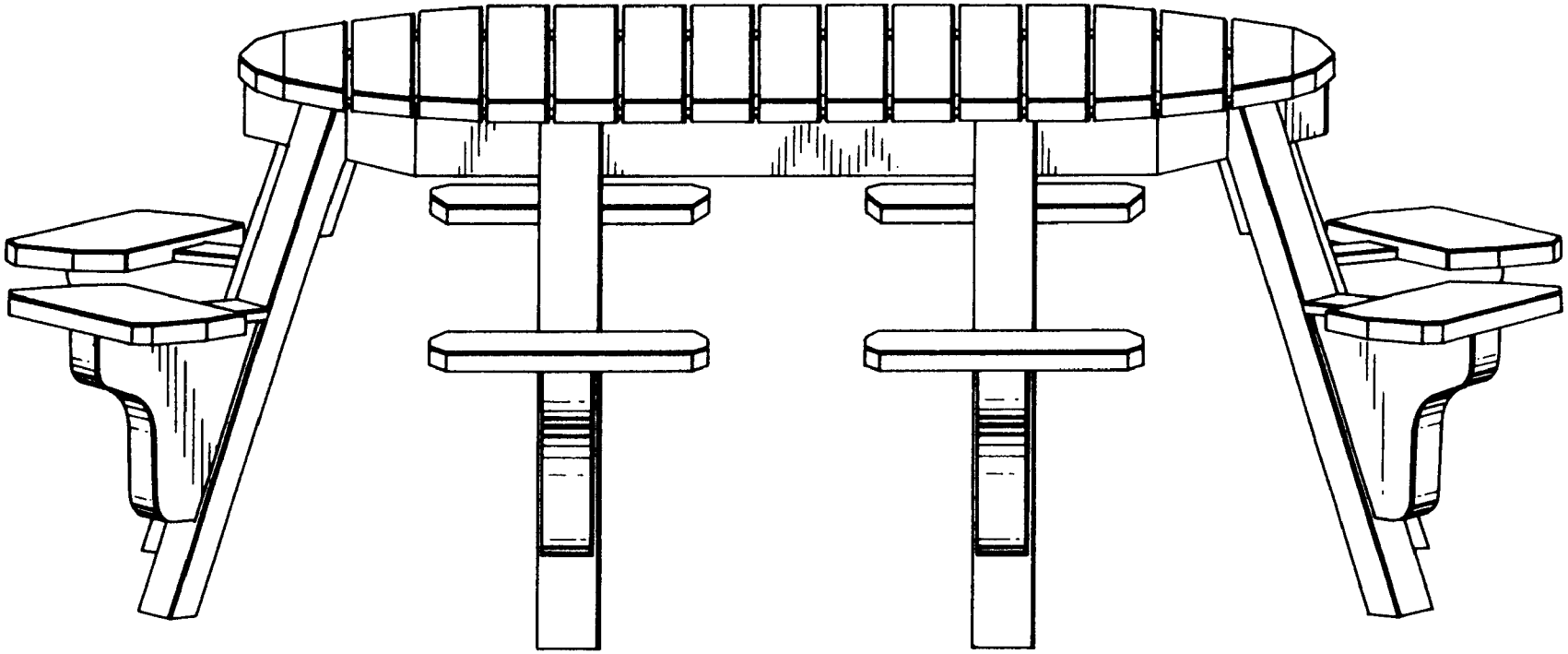
Figure 8:
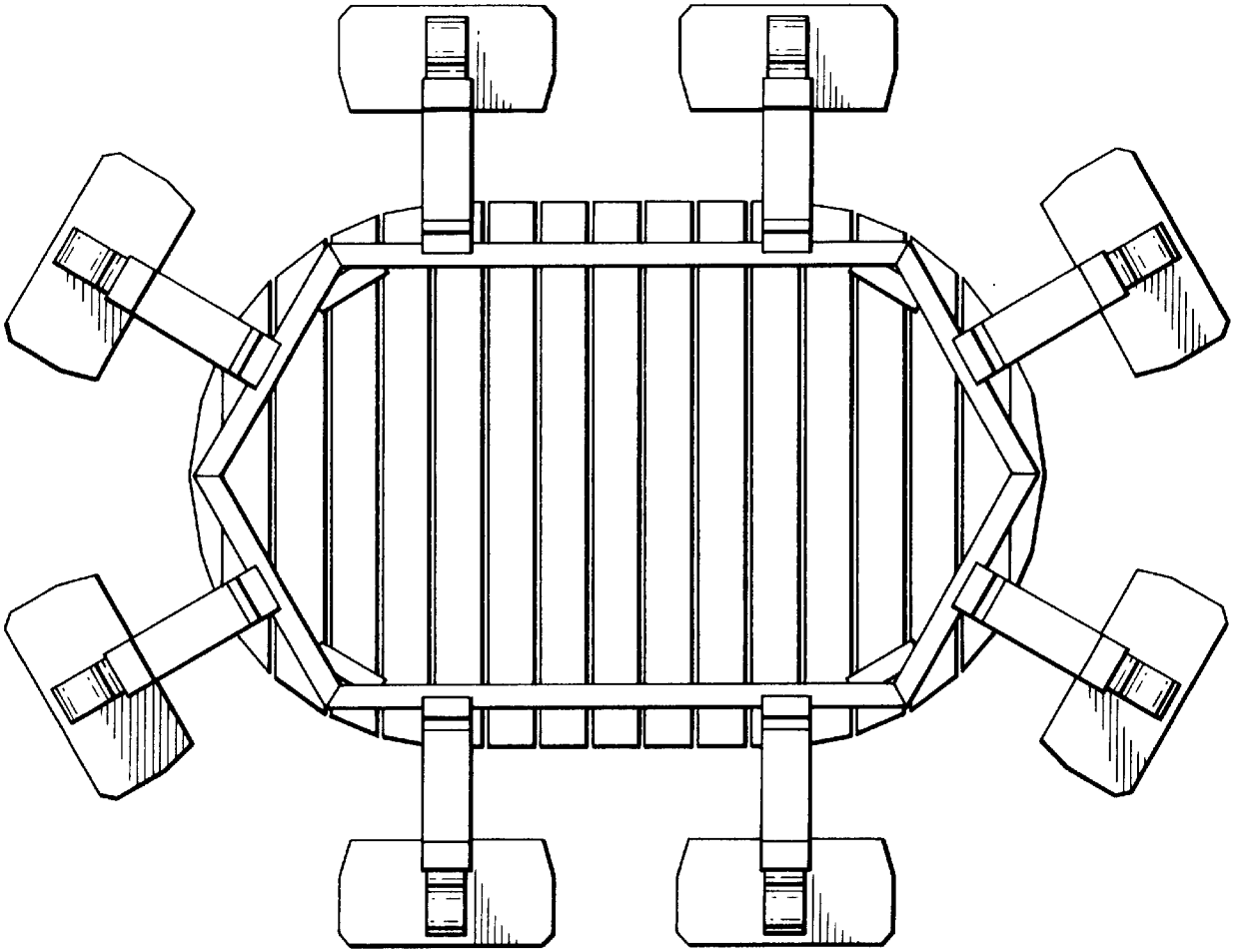
Figure 9:
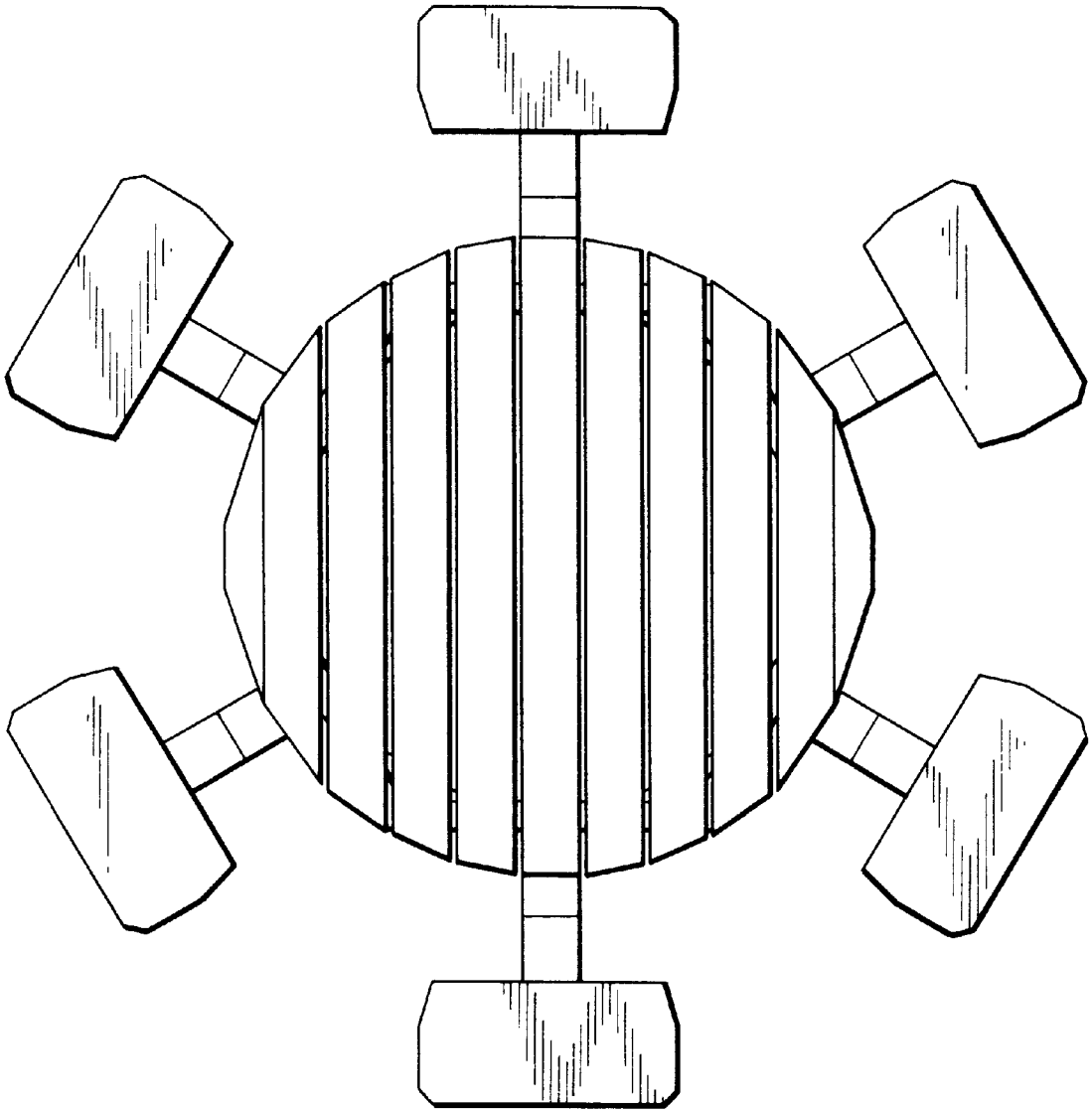
FIGS. 9–12 show respectively, top, side, perspective and underside views of a third embodiment of the present invention.
Figure 10:
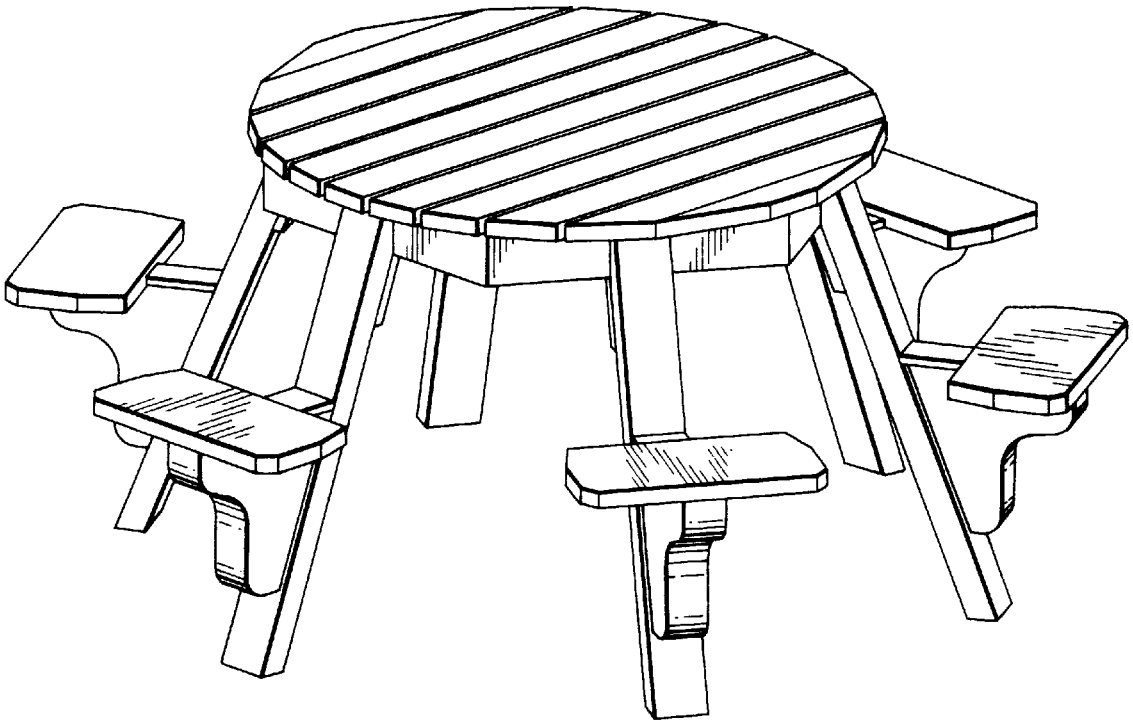
Figure 11:
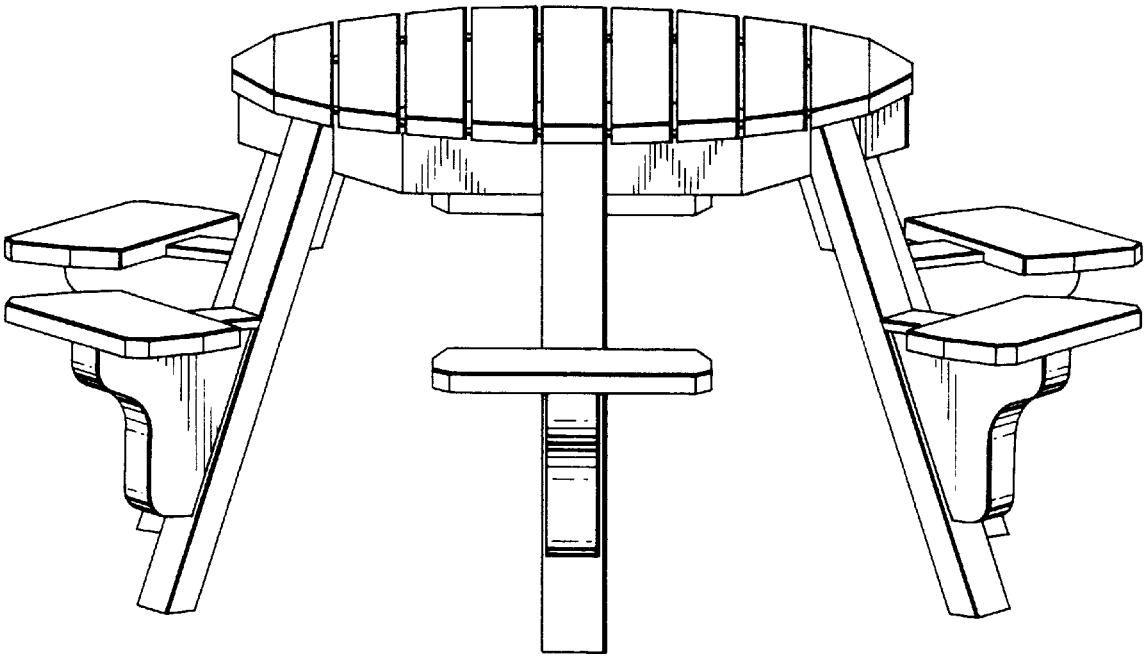
Figure 12:
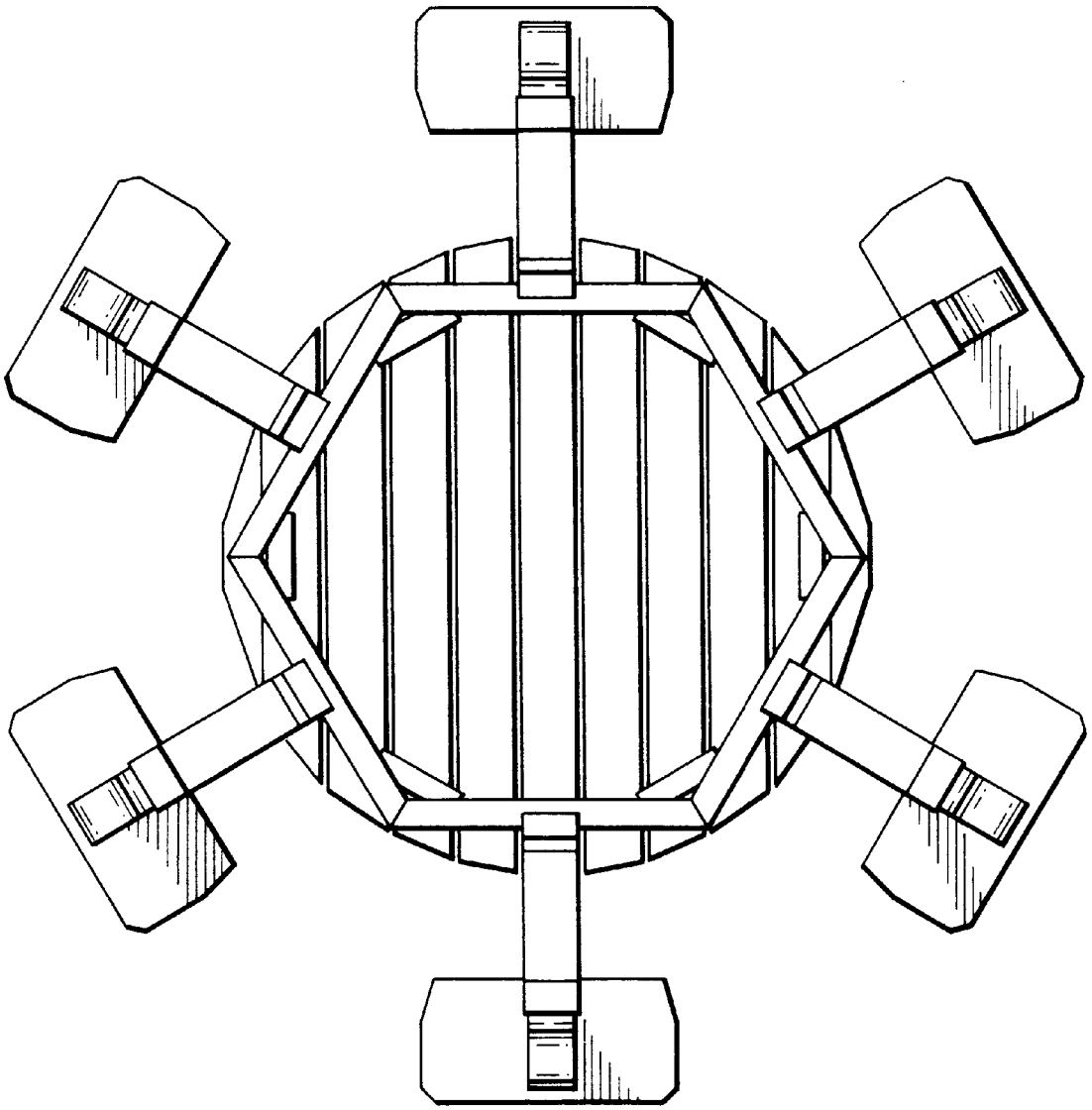
Figure 13:
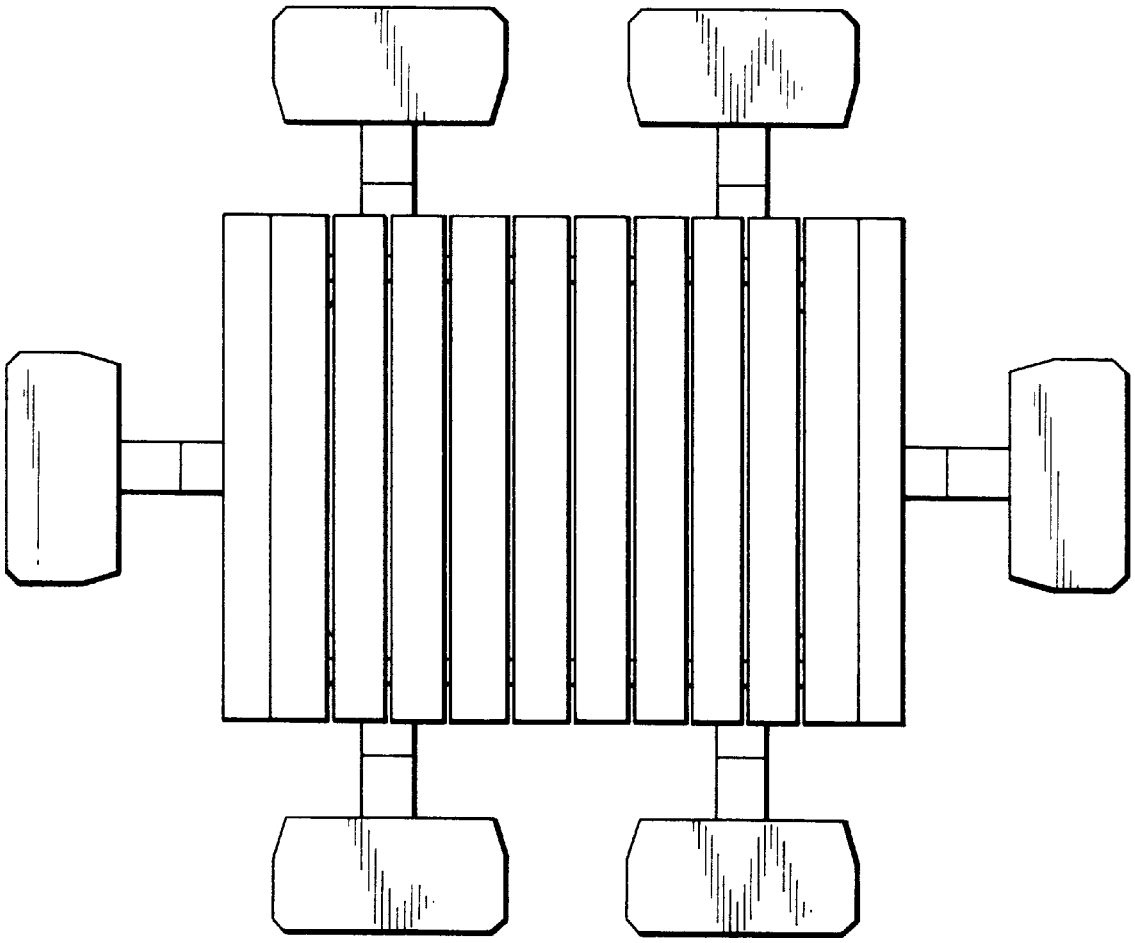
FIGS. 13–16 show respectively, top, side, perspective and underside views of a fourth embodiment of the present invention.
Figure 14:
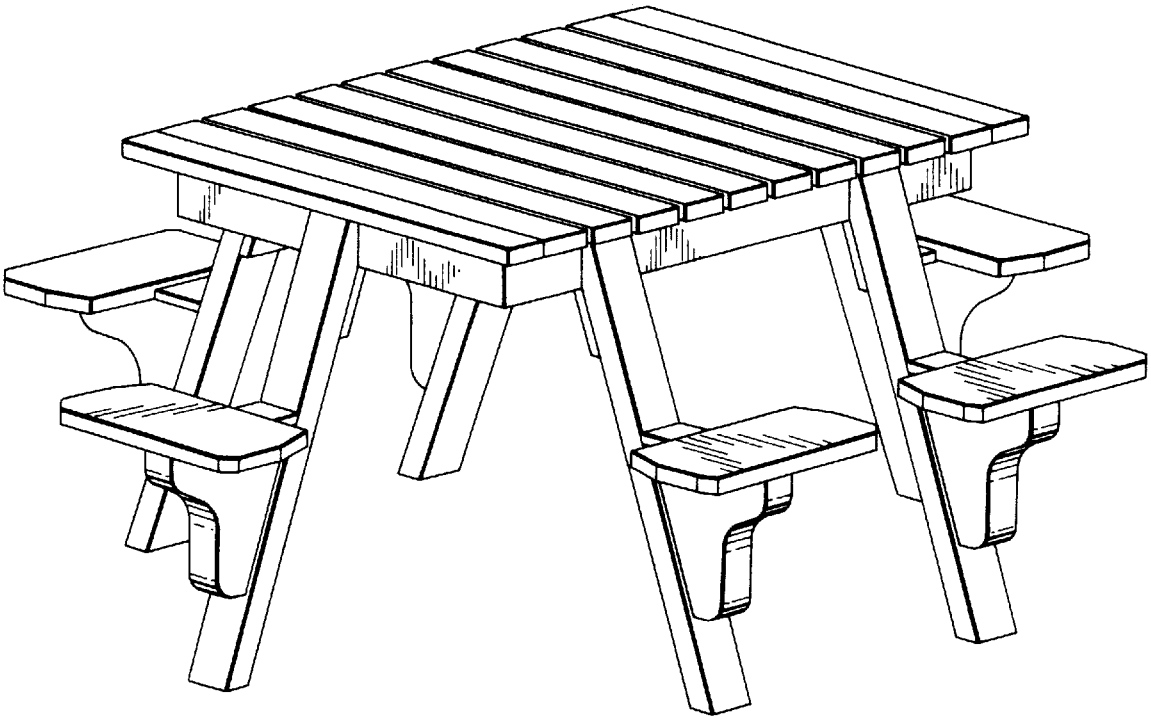
Figure 15:
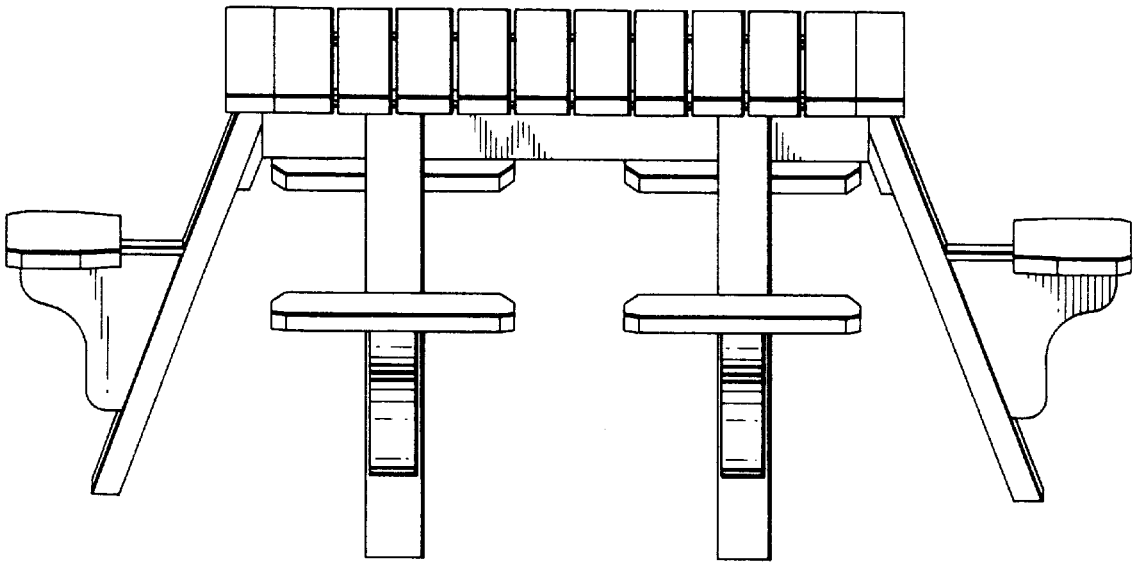
Figure 16:
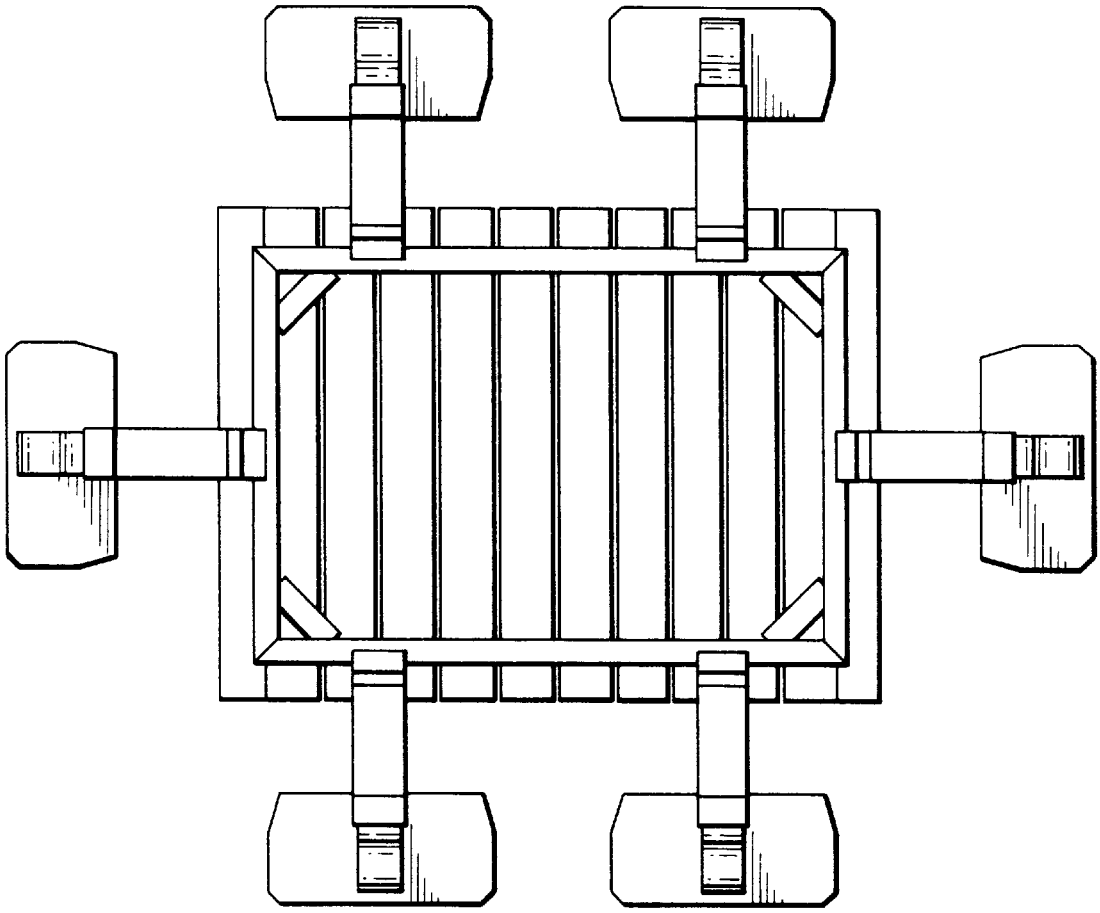
Figure 17:
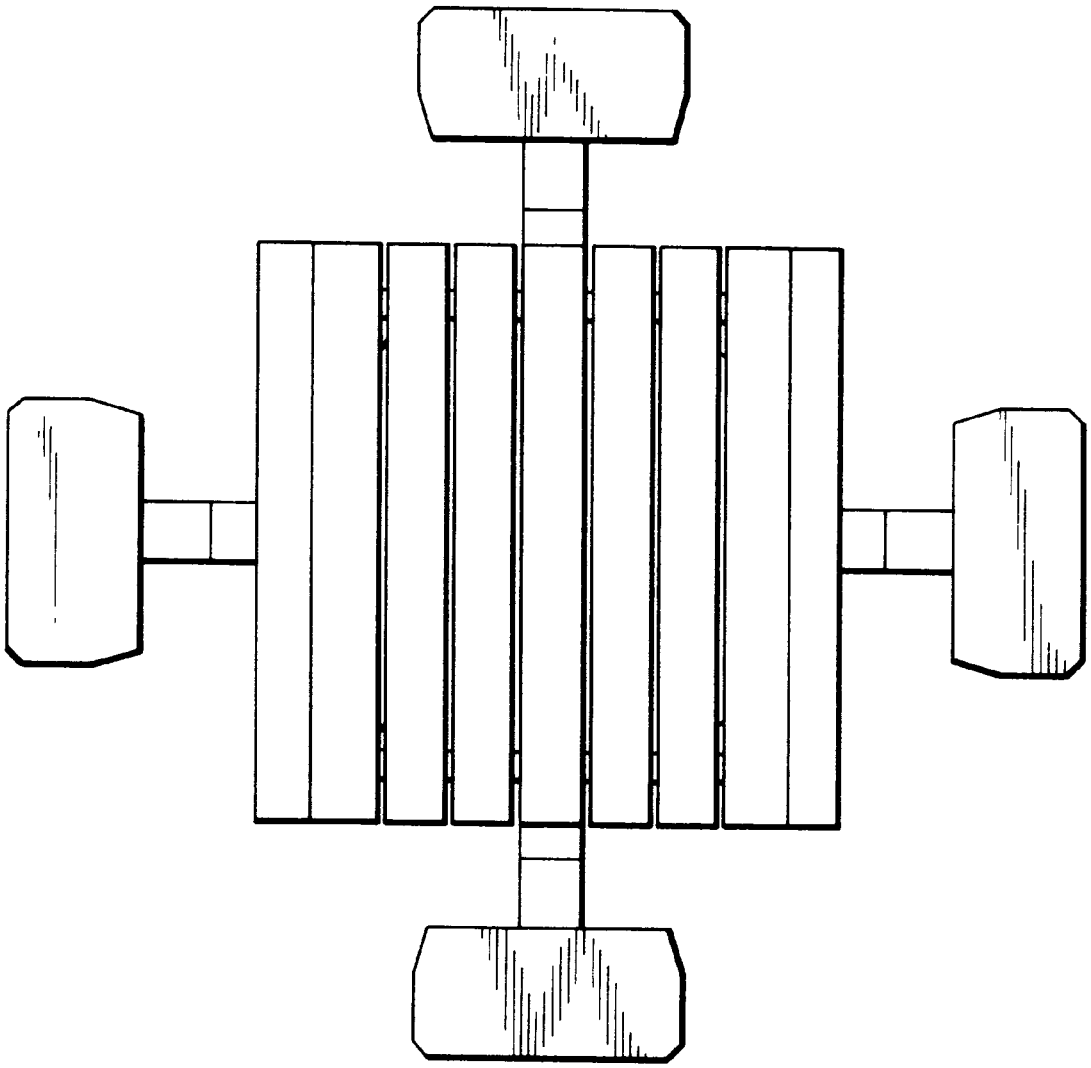
FIGS. 17–20 show respectively, top, side, perspective and underside views of a fifth embodiment of the present invention.
Figure 18:
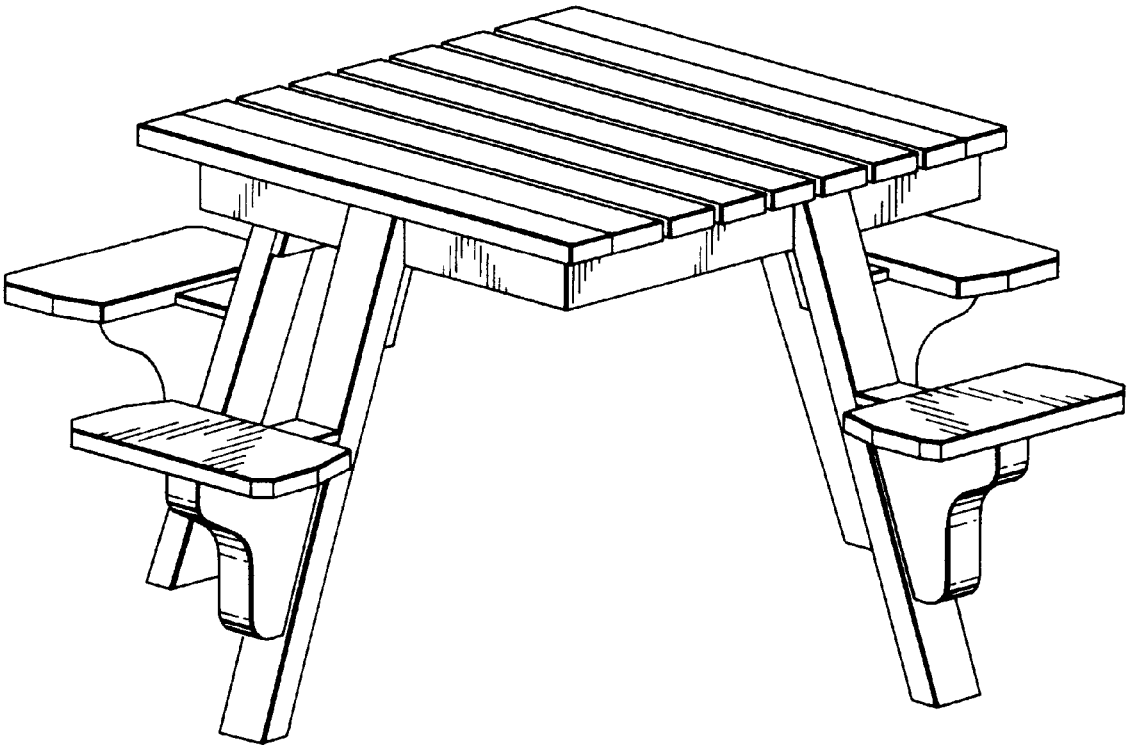
Figure 19:
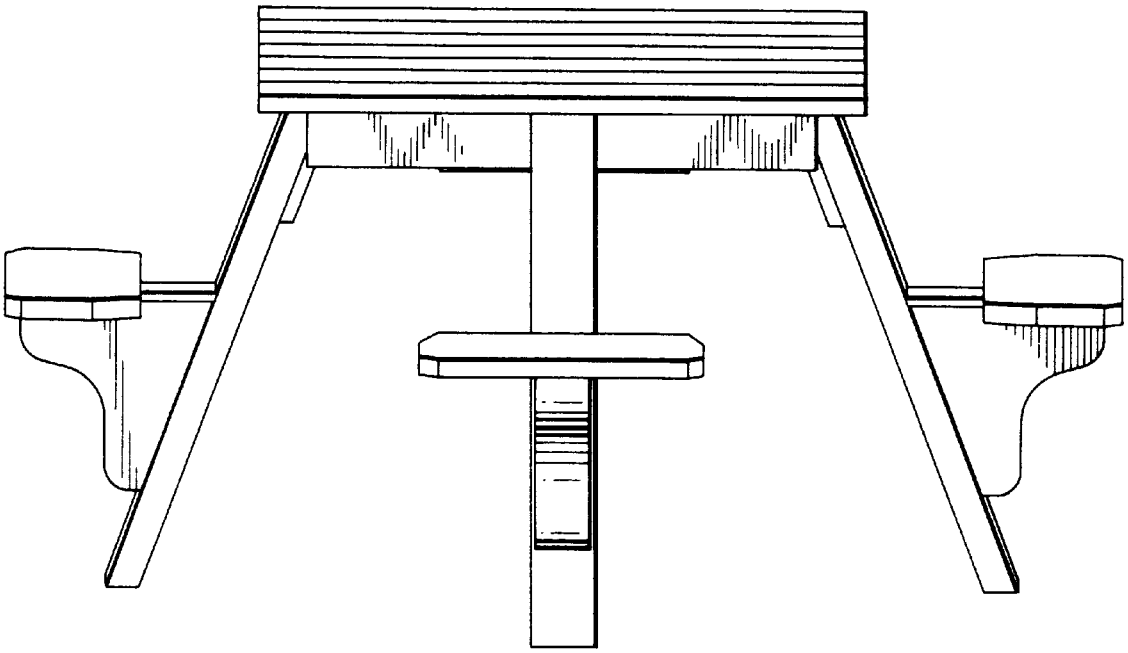
Figure 20:
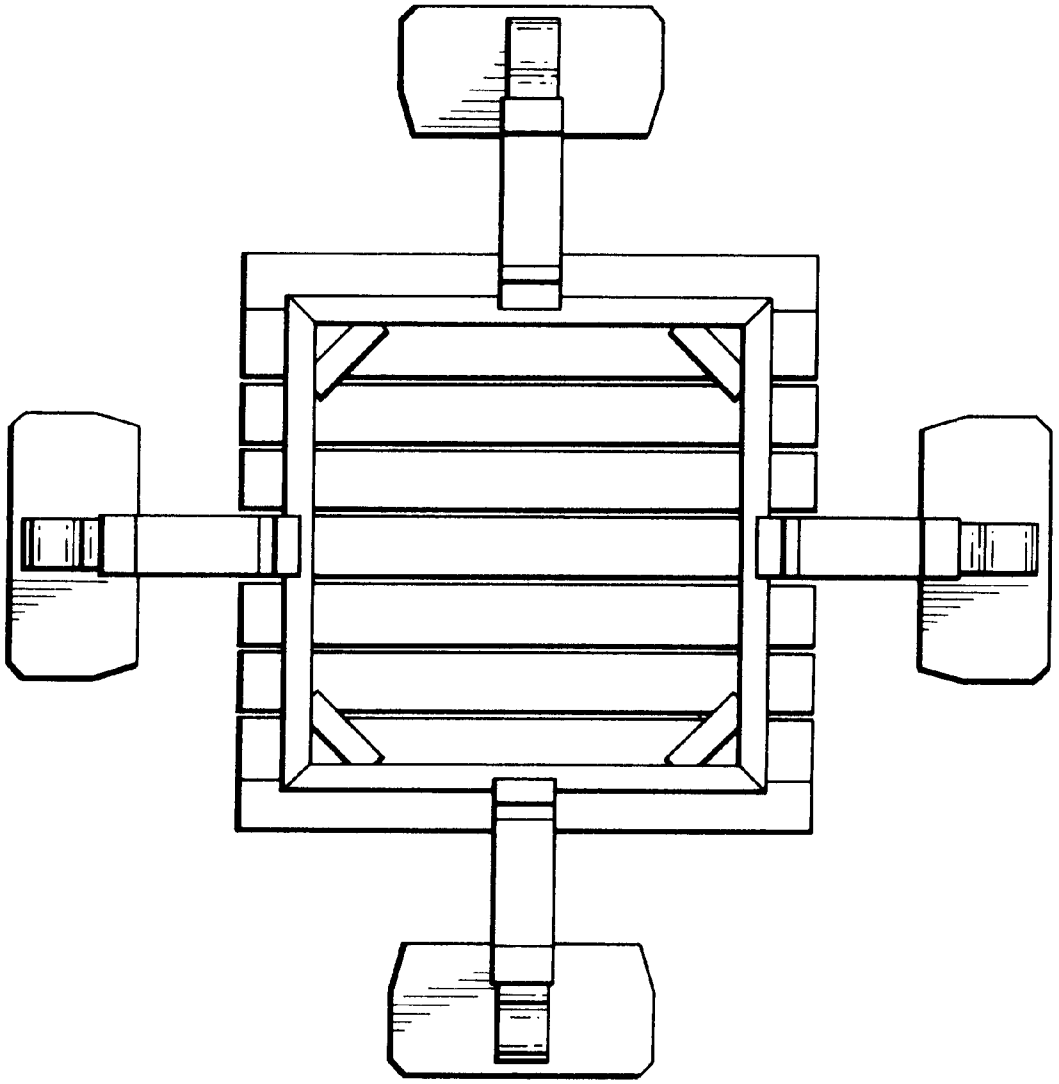
Figure 21:
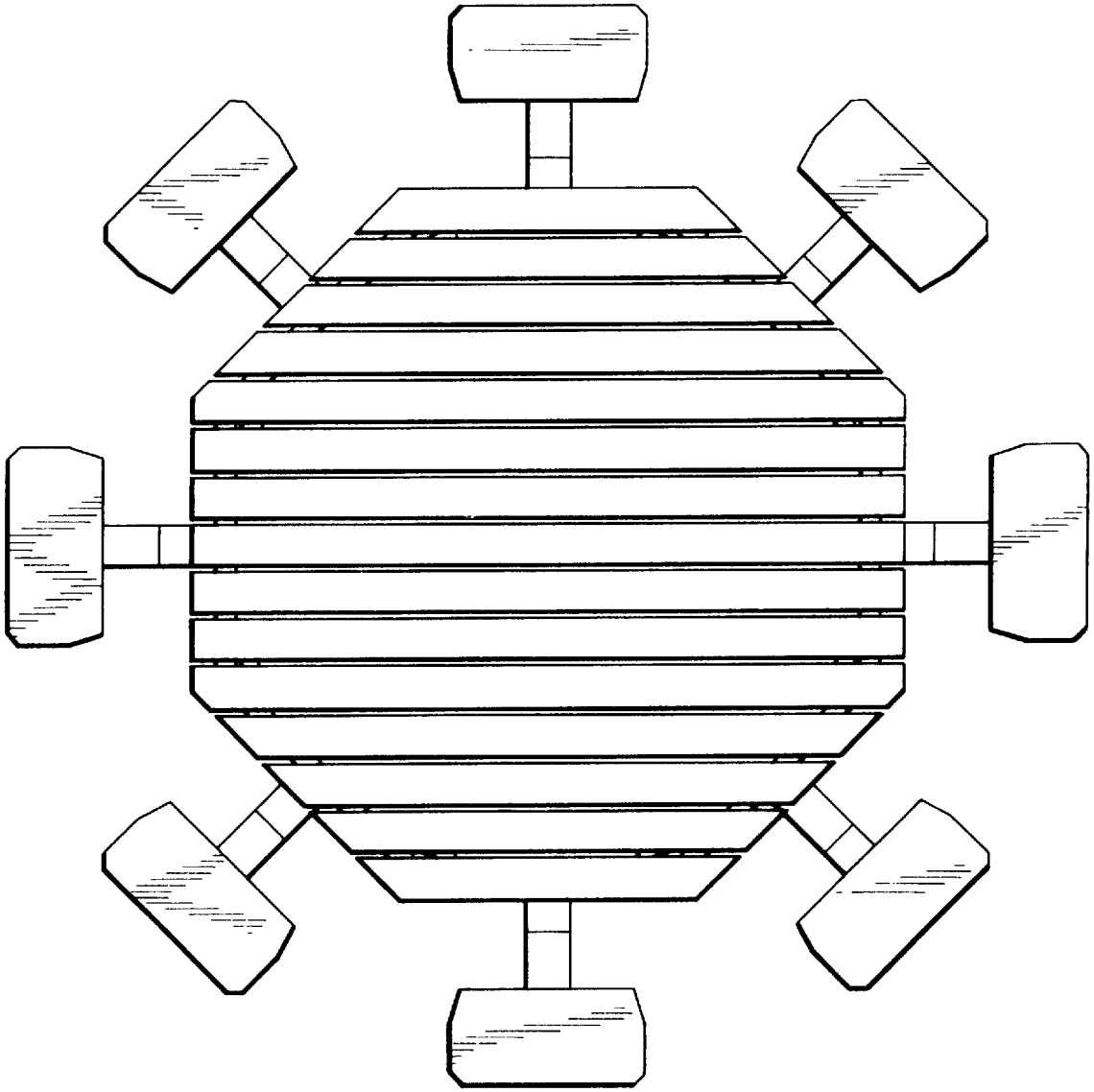
FIGS. 21–24 show respectively, top, side, perspective and underside views of a sixth embodiment of the present invention.
Figure 22:
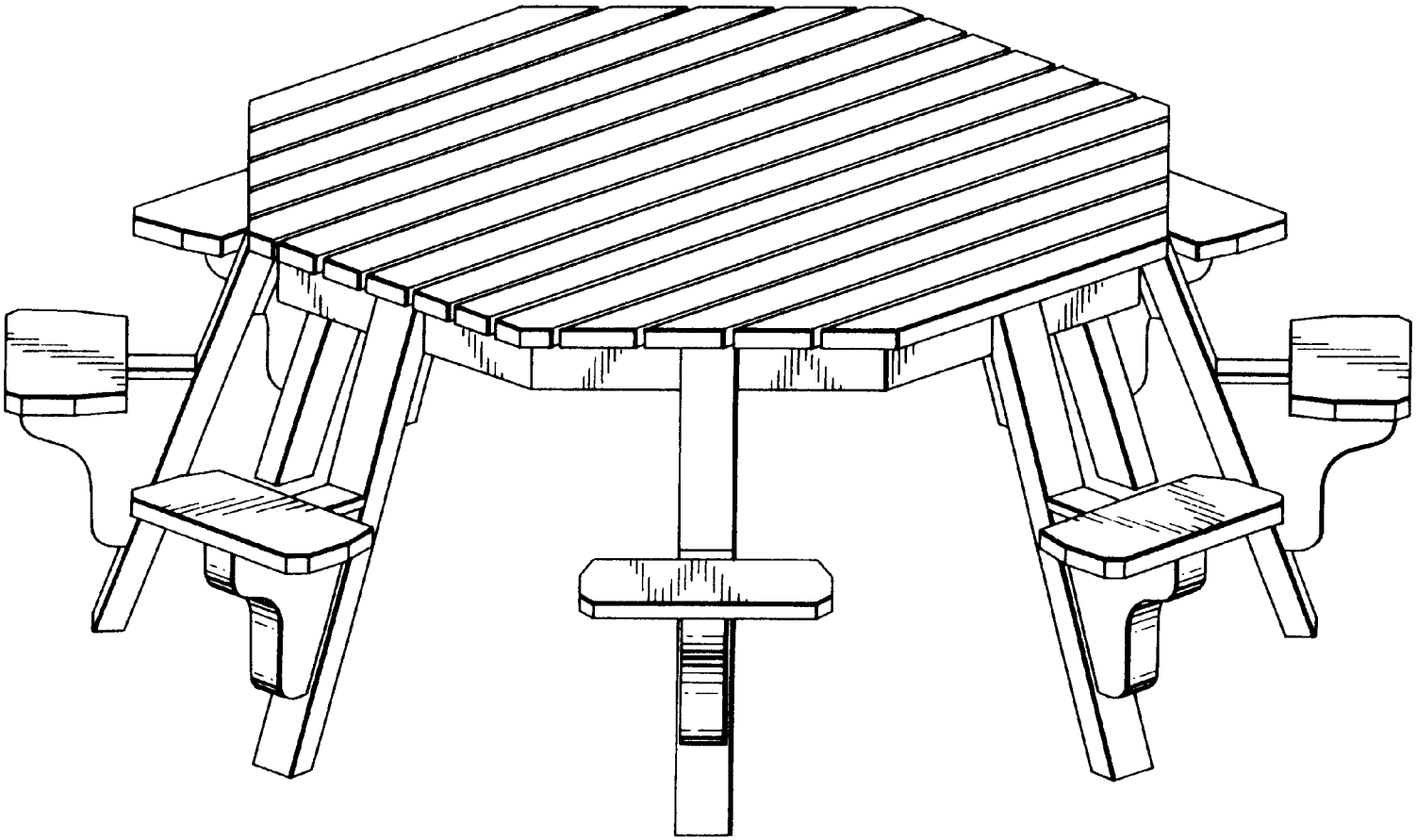
Figure 23:
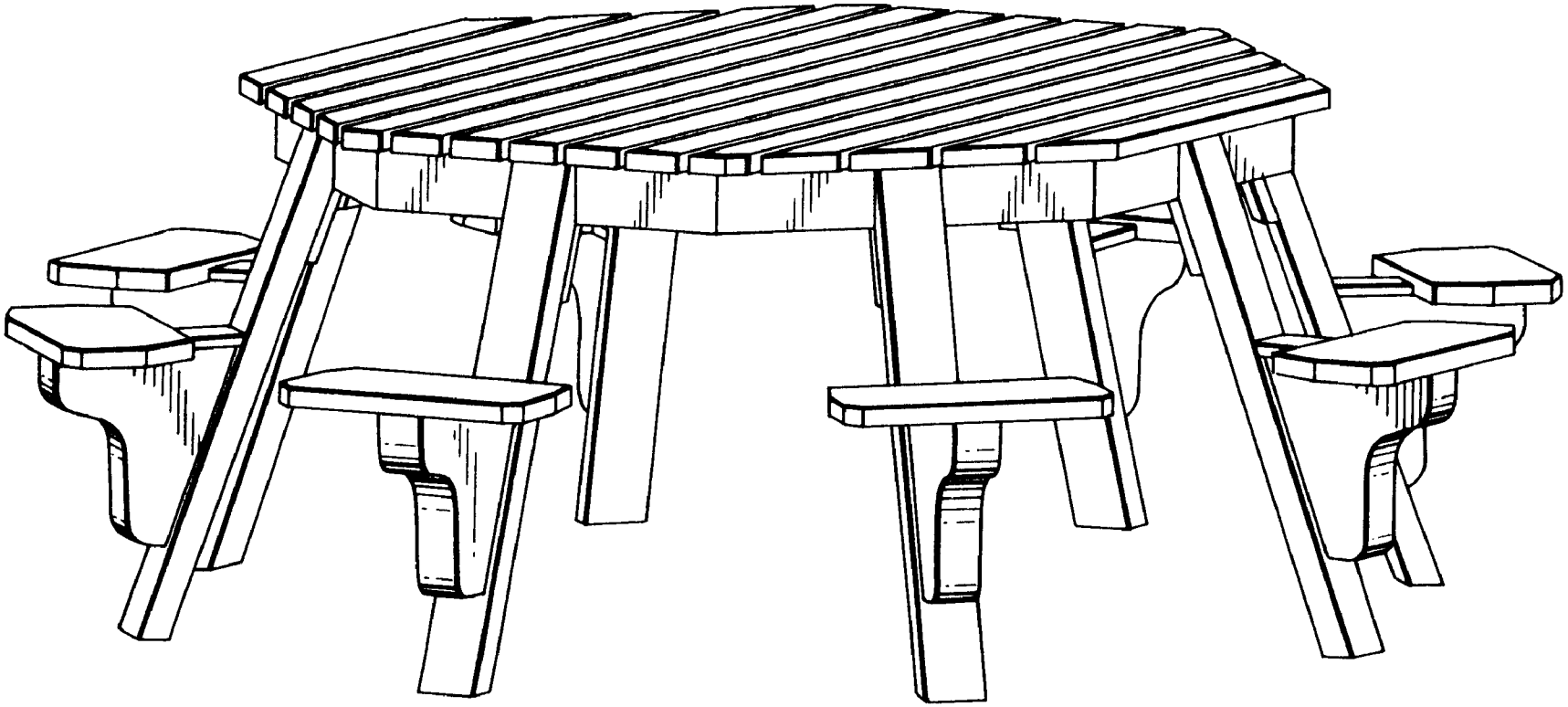
Figure 24:
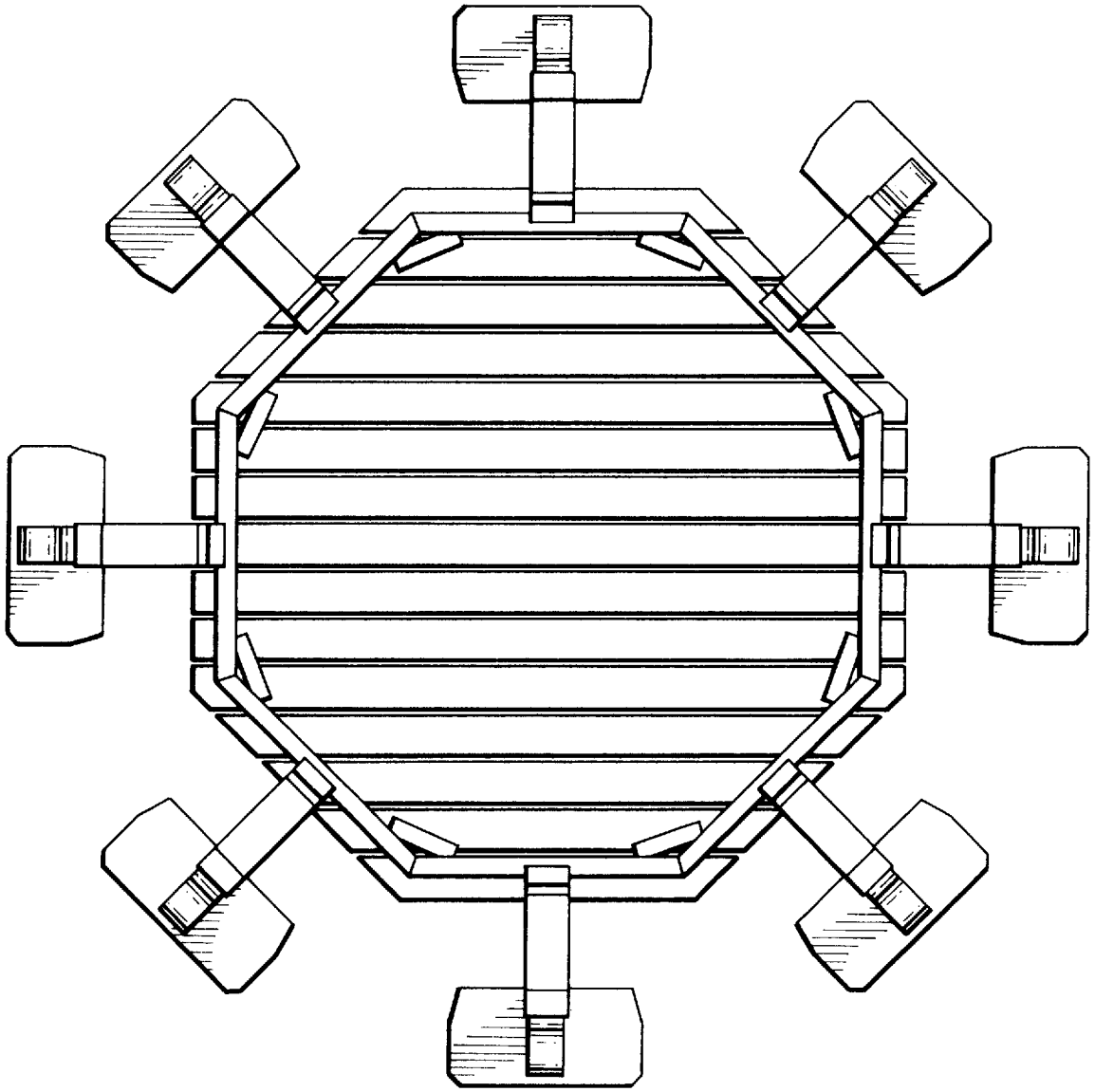

Using FIG. 3 as an illustrative example of each of the preferred embodiments that are illustrated, it can be seen that FIG. 3 consists of a multi-leg table generated referenced 1, that comprises a shaped table top 2 formed from a parallel planked assembly of wood formed into a slated arrangement.

The underside of the table top 2 comprises a plurality of table leg receiving members 6, each respective one of which is adapted to receive a table leg 3, that is fitted to the leg receiving member 6 at fixing point 8 via a flanged bolt, nut and washer assembly. Each respective leg is provided with integral seating and comprises generally two components the seat receiving member 5 and the seat 4 itself. Once each respective leg 3 has been bolted to each leg receiving member 6, an integral table as referenced generally 1 results.

Each respective leg receiving member 6 is fitted to the underside of the table top in the table top's normal attitude of operation via a plurality of wood screws (not illustrated). Similarly, each respective seat 4, is fitted to each respective seat receiving member 5, via some more wood screws. Lastly, each respective receiving member 5 is fitted to each respective leg 3 via this wood screw type system.

The resilient nature of wood that forms each respective leg 3 of the table 1, is sufficient, as a matter of deliberate design, that the weight of a person sitting on the seat will cause the leg to move into contact with the ground if it is not already ground engaging, ie, if there is initially a gap between the foot of the leg and the ground on which the rest of the table is standing.

The degree of flexibility of the leg 3 of the table 1 is such that the foot of the table 1 is capable of a vertical displacement of between 0.5–2.5 inches when a mass greater than 70 lbs occupies the seat squab 4.

FIGS. 1–4 of the present invention illustrate a substantially octagonal table comprising a table top 2 of parallel planked shaped hardwood formed into a slatted arrangement with six substantial equispaced legs 3, each respective one of which subtends an angle of between 25° and 35° from the vertical, each respective leg 3 being fitted with a leg receiving member 5 and a solid (ie, non parallel planked) seat 4.

FIGS. 5–8 illustrate a similar arrangement although in this particular example, the table top instead of being substantially octagonal in shape, comprises a rectangle with substantially rounded corners. This arrangement allows eight equispaced legs 3, each respective one of which is fitted to each respective leg receiving member 6 fitted to the underside of the table top. Once again, the angle subtended by each leg is the same and is between 25°–35° from the vertical. Each leg supports an identical seat receiving member 5 together with a solid seat, each respective one of which is substantially the same shape.

FIGS. 9–12 illustrate a similar table top although in this particular design, the table top is substantially circular, having the same arrangements of legs and seating as described previously for FIGS. 1–4.

FIGS. 13–16 show a similar design of table top 1 although in this particular embodiment, the table top is substantially rectangular in shape having two legs emanating from both of the longest sides of the rectangle and one leg emanating from each of the shortest sides of the rectangle. The angle subtended and design of the seat squab for this particular embodiment is similar to those previously described.

FIGS. 17–20 illustrate a similar design of table top 1, however in this particular embodiment the table top is substantially square with one leg emanating from each side of the square. The four legs are once again equispaced and subtend an angle of between 25° and 35° from the vertical and each respective leg supports an identical seat receiving member and seat.

FIGS. 21–24 illustrate another design of table top not too dissimilar to that described for FIGS. 1–4 wherein in this particular example, each respective side of the octagonal shape of the table top is substantially the same size. Such an arrangement allows eight legs with seating as previously described to subtend the table in the manner previously described.

Of course, the embodiments illustrated are by way of example only and a number of modifications can be made without departing from the scope of the invention. For instance, the table top could be apertured to receive a "parasol" to shield persons seated at the table from direct sunlight. Hard or softwood need not necessarily be used to manufacture the table, plastics materials could also be used as well as a range of metals/alloys. Any appropriate selection or combination of any of the above materials could also be used.

In yet further alternative embodiments not every leg 3 need necessarily incorporate a seat 4 and seat receiving member 5.

Furthermore, in alternative embodiments at least one leg 3 could incorporate a plurality of seats 4 and seat receiving members 5.

In yet a further alternative embodiment each respective leg receiving member 6, could be provided with a plurality of fixing points 8 to enable a number of legs 3 to be fitted to each respective leg receiving member 6. Alternatively, the fixing point 8 could comprise a single cut-out, so sized and shaped as to allow a plurality of legs 3 to be fitted to each respectively leg receiving member 6.

For the avoidance of doubt, in the preferred embodiments as illustrated, the centre of gravity of each respective seat 4 and seat receiving member 5 is in the same plane as the centre of gravity of each respective leg 3 that the seat 4 and seat receiving member 5 are integral with.

Specific materials or combination of materials that are particularly advantageous include mahogany, oak, walnut, beech, elm, ash, pine, yew, willow and sycamore in terms of both hardwoods and softwoods respectively. Furthermore, in terms of plastics materials, polythene, poly-vinyl chloride, nylon and polypropylene could be used. In terms of metals and metal alloys, steel, copper, tin, iron, bronze or brass could be used.

I claim:

1. A table comprising:

a table top;

at least four generally rectangular legs, each of said legs having an inner side facing toward the center of said table top, two lateral sides, an outer side opposite said inner side facing away from the center of said table top, and a lower end which is disposed to engage a floor, each of said legs being independently attached to said table top and each respective leg of said table being provided with a seat squab and mounting means for mounting said seat squab to said leg, said mounting means comprising a seat receiving member for mounting said seat squab on said outer side of each of said legs above said lower end of each leg, wherein together, each respective seat squab and seat receiving member are solely attached to said outer side of each said table leg of said table, such an arrangement enabling each respective leg of said table to be sufficiently independently resilient, so that when a person of sufficient weight is sitting on each seat squab, each one of said legs is adapted to cause said lower end of said leg to move into contact with the floor when said lower end is previously disposed above he floor.

2. A table according to claim 1 wherein said seat squab is centered relative to said leg.

3. A table according to claim 1 wherein each respective leg is disposed at a non-vertical angle.

4. A table according to claim 1 wherein each respective leg is substantially straight throughout its entire length.

* * * * *